US008052554B2

(12) United States Patent
Lee

(10) Patent No.: US 8,052,554 B2
(45) Date of Patent: Nov. 8, 2011

(54) ARROW FOR HUNTING

(76) Inventor: Young Ki Lee, Busan (KR)

( * ) Notice: Subject to any disclaimer, the term of this patent is extended or adjusted under 35 U.S.C. 154(b) by 16 days.

(21) Appl. No.: 12/770,266

(22) Filed: Apr. 29, 2010

(65) Prior Publication Data

US 2010/0279803 A1 Nov. 4, 2010

(30) Foreign Application Priority Data

Apr. 30, 2009 (KR) ..... 10-2009-0038148

(51) Int. Cl.
*F42B 6/08* (2006.01)

(52) U.S. Cl. ..... 473/583

(58) Field of Classification Search ..... 473/578, 473/582, 583, 584
See application file for complete search history.

(56) References Cited

U.S. PATENT DOCUMENTS

| | | | | |
|---|---|---|---|---|
| 5,257,809 | A * | 11/1993 | Carrizosa | 473/584 |
| 7,232,390 | B2 * | 6/2007 | Mizek et al. | 473/583 |
| 2006/0030438 | A1 * | 2/2006 | Hajek | 473/583 |
| 2010/0009789 | A1 * | 1/2010 | Byrne | 473/584 |

* cited by examiner

*Primary Examiner* — John Ricci
(74) *Attorney, Agent, or Firm* — Birch, Stewart, Kolasch & Birch, LLP

(57) ABSTRACT

Disclosed herein is an arrow for hunting. The arrow includes an arrow shaft having a predetermined length and including a nock on one end and a shaft threaded part in the other end. A plurality of feathers is positioned to be adjacent to the nock of the arrow shaft. A connector includes a connecting threaded part fastened to the shaft threaded part, a stopper, and a penetration threaded part. An arrowhead is connected to the connector in such a way as to be opposite to the connecting threaded part. A penetration rotary unit has a threaded part to be fastened to the penetration threaded part of the connector, is shorter than the penetration threaded part, and has wings. A spring is positioned between the stopper and the penetration rotary unit, and provides a restoring force to bias the penetration rotary unit toward the arrowhead.

13 Claims, 3 Drawing Sheets

ARROW FOR HUNTING

BACKGROUND OF THE INVENTION

1. Field of the Invention

The present invention relates generally to arrows and, more particularly, to an arrow for hunting which makes game which is shot by the arrow bleed profusely, thus preventing the game from going for a great distance, therefore allowing the game to be easily caught.

2. Description of the Related Art

Generally, firearms and arrows have been widely used as a hunting tool for capturing animals. Especially in the U.S.A., some states legally control the use of firearms, so that only arrows are accepted as the hunting tool.

The arrow for hunting includes at its front end an arrowhead which has a sharp tip. When the arrow flies from a bowstring and comes into contact with the body of game, the sharp tip of the arrowhead sticks into the body of the game. Thereby, the hunting arrow becomes stuck in the body of the game and the game loses blood, so that the game is captured. If the flying speed of the arrow is high, the arrow may be shot through the body of the game.

However, the conventional arrow for hunting is problematic in that game spills a relatively small amount of blood, so that the game hit by the arrow may move away for a long distance, and thus a long time and a lot of effort are required to capture the game.

That is, after game is hit by the hunting arrow, the game must spill as much blood as possible so that the game does not move a long distance and may easily be captured. Even if the conventional arrow for hunting hits game, the game spills a small amount of blood, so that the game hit by the arrow may move a long distance while spilling blood. Consequently, a long time and a lot of effort are required to capture the game.

SUMMARY OF THE INVENTION

Accordingly, the present invention has been made keeping in mind the above problems occurring in the prior art, and an object of the present invention is to provide an arrow for hunting, which becomes stuck into the body of game while being rotated, and in which a sharp wing provided on a penetration rotary unit can be further rotated even after the arrow sticks into the body of the game, so that the game hit by the arrow spills a larger amount of blood and does not move a long distance, thus allowing the game to be easily captured.

In order to accomplish the above object, the present invention provides an arrow for hunting, including an arrow shaft, a plurality of feathers, a connector, an arrowhead, a penetration rotary unit, and a spring. The arrow shaft has a predetermined length, and includes a nock provided on a first end of the arrow shaft such that a bowstring of a bow is inserted into the nock, and a shaft threaded part provided in a second end of the arrow shaft and having threads. The feathers are positioned to be adjacent to the nock of the arrow shaft and provided along an outer circumference of the arrow shaft at regular intervals, each of the feathers having a shape of a thin plate which protrudes from a surface of the arrow shaft. The connector includes a connecting threaded part which is fastened to the shaft threaded part of the arrow shaft in a threaded manner, a stopper which extends from the connecting threaded part and has a diameter larger than that of the connecting threaded part to be in contact with an end of the arrow shaft, and a penetration threaded part which extends from the stopper in a direction opposite to the connecting threaded part and has a diameter smaller than that of the stopper, with threads formed on an outer circumference of the penetration threaded part. The arrowhead is connected to the connector in such a way as to be opposite to the connecting threaded part and has a sharp tip. The penetration rotary unit has on an inner circumference thereof a threaded part to be fastened to the penetration threaded part of the connector in a threaded manner, has a length shorter than that of the penetration threaded part, and has on an outer circumference thereof wings arranged at regular intervals, each of the wings having a shape of a triangular plate which is sharp at a tip thereof. The spring is positioned between the stopper and the penetration rotary unit, and provides a restoring force to bias the penetration rotary unit toward the arrowhead.

Further, a longitudinal central line of each of the wings may be inclined relative to a longitudinal central line of the penetration rotary unit, and each of the wings may have a section which is curved in an arc shape.

Further, a longitudinal central line of each of the feathers may be inclined relative to a longitudinal central line of the arrow shaft, so that air resistance affects the feathers while the arrow shaft is flying, thus allowing the arrow shaft to rotate when flying.

Further, an entire portion of the penetration rotary unit may be made of metal, or plastic may be prepared for a cylindrical body of the penetration rotary unit and metal may be prepared for the wings such that the penetration rotary unit is formed through injection molding, or the penetration rotary unit may be formed through powder injection molding (PIM) using metal powder.

Further, the threads of the penetration threaded part and the threaded part provided on the inner circumference of the penetration rotary unit may be formed into one of a double-thread screw to a five-thread screw.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, an arrow for hunting according to the preferred embodiment of the present invention will be described in detail with reference to the accompanying drawings.

Figure 1:
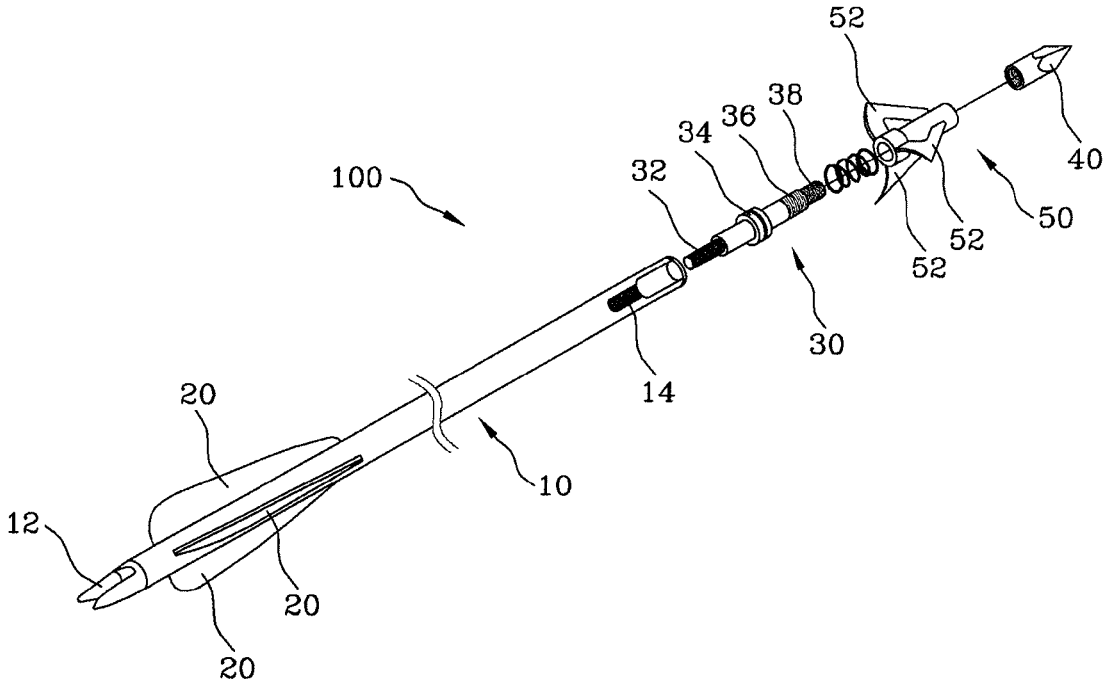
FIG. 1 is an exploded perspective view illustrating an arrow for hunting according to an embodiment of the present invention.
Figure 2:
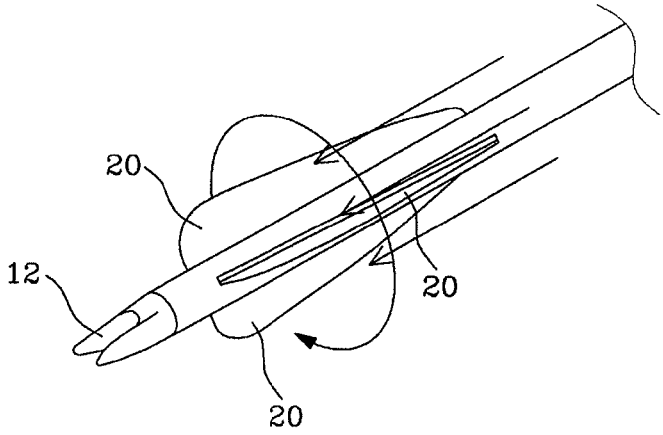
FIG. 2 is a view illustrating feathers of the arrow of FIG. 1.
Figure 3:
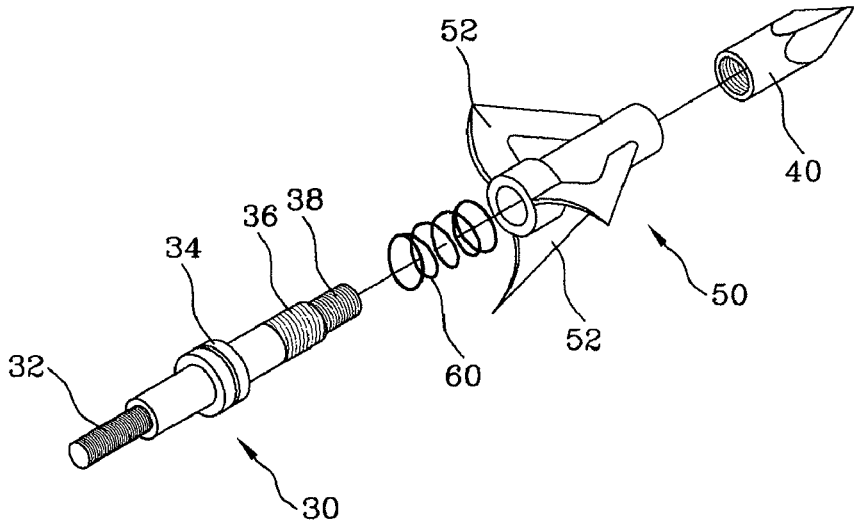
FIG. 3 is an exploded perspective view illustrating a connector, an arrowhead and a penetration rotary unit of the arrow of FIG. 1.

FIGS. 1 to 7 illustrate an arrow for hunting according to the embodiment of the present invention. FIG. 1 is an exploded perspective view illustrating an arrow for hunting according to an embodiment of the present invention, FIG. 2 is a view illustrating feathers of the arrow of FIG. 1, FIG. 3 is an exploded perspective view illustrating a connector, an arrowhead and a penetration rotary unit of the arrow of FIG. 1, FIG.

Figure 5:
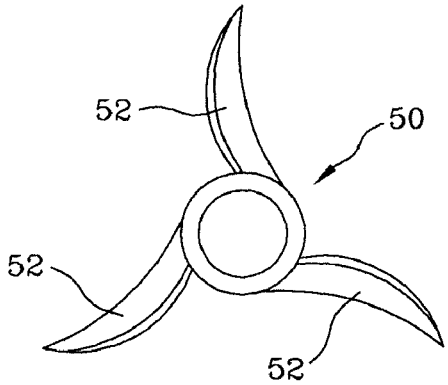
FIG. 5 is a side view illustrating the penetration rotary unit of the arrow of FIG. 1.
Figure 6:
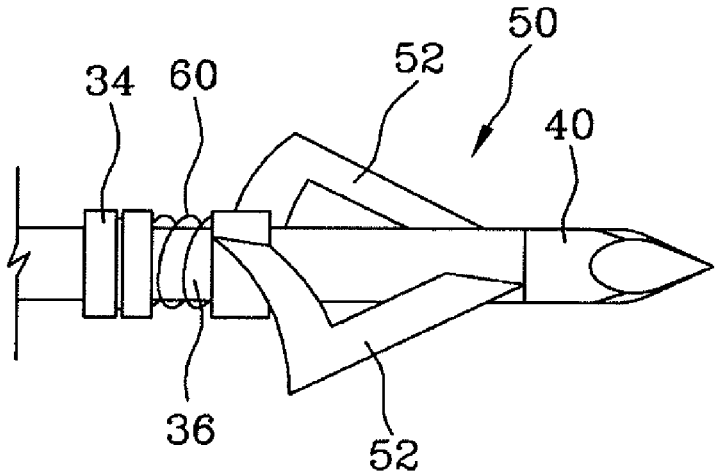
FIGS. 6 and 7 are views illustrating the use of the arrow of FIG. 1.
Figure 7:
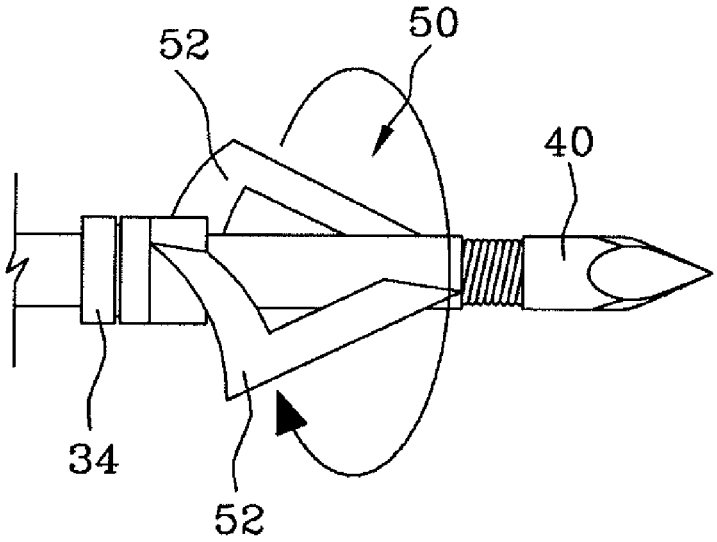

4 is a plan view illustrating the penetration rotary unit of the arrow of FIG. 1, FIG. 5 is a side view illustrating the penetration rotary unit of the arrow of FIG. 1, and FIGS. 6 and 7 are views illustrating the use of the arrow of FIG. 1.

As shown in the drawings, the arrow 100 for hunting according to the embodiment of the present invention includes an arrow shaft 10, a plurality of feathers 20, a connector 30, an arrowhead 40, a penetration rotary unit 50, and a spring 60.

Referring to FIG. 1, the arrow shaft 10 has a predetermined length. A nock 12 is provided on one end of the arrow shaft 10 so that a bowstring is inserted into the nock 12. A shaft threaded part 14 having threads is provided in the other end of the arrow shaft 10.

The feathers 20 are placed to be adjacent to the nock 12 of the arrow shaft 10 and provided on the outer circumference of the arrow shaft 10 at regular intervals. Each feather 20 has the shape of a thin plate which protrudes from the surface of the arrow shaft 10.

As shown in FIG. 2, the longitudinal central line of each feather 20 is inclined with respect to the longitudinal central line of the arrow shaft 10. Thus, while the arrow shaft 10 is flying, the thin and wide plate of the feather 20 is subjected to air resistance and collides with the air. By force acting on the feather 20 when it collides with the air, the arrow shaft 10 is rotated when flying.

As the arrow shaft 10 flies while rotating, the arrowhead 40 and wings 52 also rotate together. Consequently, when the hunting arrow 100 according to the present invention is stuck into the body of game, the arrow 100 is rotated. Thus, as soon as the hunting arrow 100 is stuck into the body of the game, the body tissue of the game is greatly destroyed, so that the game spills a larger amount of blood.

The connector 30 has a connecting threaded part 32, a stopper 34 and a penetration threaded part 36.

The connecting threaded part 32 is fastened to the shaft threaded part 14 of the arrow shaft 10.

The stopper 34 extends from the connecting threaded part 32 and has a diameter than that of the connecting threaded part 32 in such a way as to be in contact with an end of the arrow shaft 10.

The penetration threaded part 36 extends from the stopper 34 in such a way as to be opposite to the connecting threaded part 32 and has a diameter than that of the stopper 34, with threads provided on the outer circumference of the penetration threaded part 36.

The arrowhead 40 is coupled to the connector 30 in such a way as to be opposite to the connecting threaded part 32, and the tip of the arrowhead 40 is formed to be sharp.

Threads are formed in the inner circumference of the arrowhead 40. A coupling threaded part 38, having on its outer circumference threads, extends from an end of the penetration threaded part 36 of the connector 30, so that the coupling threaded part 38 is fastened to the arrowhead 40 in a threaded manner, thus coupling the arrowhead 40 with the connector 30.

As shown in FIG. 3, the penetration rotary unit 50 has on its inner circumference a threaded part, so that the penetration rotary unit 50 is fastened to the penetration threaded part 36 of the connector 30 in a threaded manner. The penetration rotary unit 50 is shorter in length than the penetration threaded part 36. Further, the wings 52 are placed at regular intervals on the outer circumference of the penetration rotary unit 50. Each wing 52 has the shape of a triangular plate which is sharp at its tip.

The entire portion of the penetration rotary unit 50 may be made of metal. Further, plastic is prepared for a cylindrical body of the penetration rotary unit 50 and metal is prepared for the wings 52, so that the cylindrical body and wings 52 of the penetration rotary unit 50 may be manufactured through injection molding. Moreover, the penetration rotary unit 50 may be manufactured through powder injection molding (PIM) using metal powder. Since the PIM method is the known art which has been currently used, a detailed description will be omitted.

The spring 60 is positioned between the stopper 34 and the penetration rotary unit 50, and provides a restoring force to bias the penetration rotary unit 50 towards the arrowhead 40.

Figure 4:
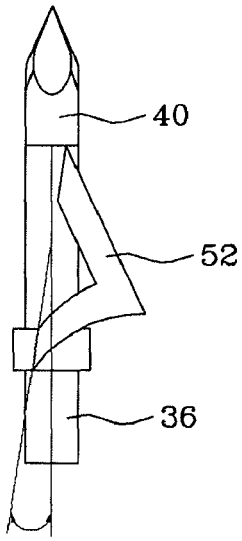
FIG. 4 is a plan view illustrating the penetration rotary unit of the arrow of FIG. 1.

Meanwhile, as shown in FIG. 4, the longitudinal central line of each wing 52 is inclined at a predetermined angle relative to the longitudinal central line of the penetration rotary unit 50. The angle preferably ranges from 2 degrees to degrees. Most preferably, the angle is 5 degrees. Further, as shown in FIG. 5, each wing 52 has a section which is curved in an arc shape.

Thus, while the arrow shaft 10 is flying, the wings 52 of the penetration rotary unit 50 are subjected to a rotating force because of air resistance. However, since the penetration rotary unit 50 is not moved backwards while being rotated by the restoring force of the spring 60, the rotating force acting on the penetration rotary unit 50 caused by the air resistance rotates the arrow shaft 10. Thus, the above-mentioned shape of wings 52 allows the entire arrow 100 to fly while rotating.

Preferably, each of the penetration threaded part 36 and the penetration rotary unit 50 is formed into one of a double-thread screw to a five-thread screw. Most preferably, it is formed into a four-thread screw.

Meanwhile, when the penetration rotary unit 50 sticks into the body of game, the penetration rotary unit 50 moves backwards while compressing the spring 60 because of resistance to the body of the game. Here, the penetration rotary unit 50 is fastened to the penetration threaded part 36 in a threaded manner. Therefore, as shown in FIG. 7, the penetration rotary unit 50 additionally makes several turns in a direction in which the threads of the penetration threaded part 36 are formed, and moves away from the arrowhead 40. Preferably, the threads of the penetration threaded part 36 and the threaded part of the penetration rotary unit 50 are formed such that the moving distance of the penetration rotary unit 50 is 3 to 6 mm when the penetration rotary unit 50 rotates once. It is most preferable that the moving distance of the penetration rotary unit 50 is 4 mm when the penetration rotary unit 50 rotates once. Further, the length of the threads of the penetration threaded part 36 and the threaded part of the penetration rotary unit 50 may be determined such that the wings 52 rotate once when the wings 52 stick into the body of the game, but may be determined such that the wings 52 rotate less than or more than once.

As such, even after the penetration rotary unit 50 is stuck into the body of game, the arrow additionally rotates and thus the body tissue of the game is further damaged. Thereby, the game spills a larger amount of blood, so that the game does not move a long distance and falls down.

The arrow 100 for hunting according to the embodiment of the present invention, which is constructed as described above, is used as follows.

First, as shown in FIG. 6, the arrow 100 for hunting according to the present invention is used in the state in which the arrowhead 40 is in close contact with the penetration rotary unit 50 because of the restoring force of the spring 60.

The bowstring is fitted into the nock 12 and drawn. In this state, the arrow 100 for hunting according to the present invention is shot at game.

Thereafter, the hunting arrow 100 flies. While the arrow 100 is flying, air resistance acts on the feathers 20 and the wings 52 of the penetration rotary unit 50, so that the arrow shaft 10 is rotated and thus the hunting arrow 100 flies while rotating.

While the hunting arrow 100 flies a predetermined distance, the arrow 100 comes into contact with the body of game and sticks into the body to a predetermined depth.

At this time, the arrowhead 40 and the penetration rotary unit 50 fly while rotating, and stick into the body of game while rotating, thus injuring the body of the game.

Further, because of resistance to the body of the game when the penetration rotary unit 50 sticks into the body of the game, the penetration rotary unit 50 moves backwards while compressing the spring 60. Here, since the penetration rotary unit 50 is fastened to the penetration threaded part 36 in a threaded manner, as shown in FIG. 7, the penetration rotary unit 50 rotates further in a direction in which the threads of the penetration threaded part 36 are formed, and moves away from the arrowhead 40.

Thus, the wings 52 of the penetration rotary unit 50 having sharp tips further damage the body tissue of game while being additionally rotated in the body of the game, so that the game spills a larger amount of blood and thus does not move and falls down.

Therefore, hunters can more easily capture game.

As described above, the present invention provides an arrow for hunting, which becomes stuck into the body of game while being rotated, and in which a sharp wing provided on a penetration rotary unit can be further rotated in the body of the game even after the arrow sticks into the body of the game, so that the game hit by the arrow spills a larger amount of blood and does not move a long distance, thus allowing the game to be easily captured.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An arrow for hunting, comprising:

an arrow shaft having a predetermined length, and including:

a nock provided on a first end of the arrow shaft such that a bowstring of a bow is inserted into the nock; and a shaft threaded part provided in a second end of the arrow shaft and having threads;

a plurality of feathers positioned to be adjacent to the nock of the arrow shaft, and provided along an outer circumference of the arrow shaft at regular intervals, each of the feathers having a shape of a plate which protrudes from a surface of the arrow shaft;

a connector including:

a connecting threaded part fastened to the shaft threaded part of the arrow shaft in a threaded manner;

a stopper extending from the connecting threaded part, and having a diameter larger than that of the connecting threaded part to be in contact with an end of the arrow shaft; and, a penetration threaded part extending from the stopper in a direction opposite to the connecting threaded part, and having a diameter smaller than that of the stopper, with threads formed on an outer circumference of the penetration threaded part;

an arrowhead connected to the connector in such a way as to be opposite to the connecting threaded part, and having a sharp tip;

a penetration rotary unit having on an inner circumference thereof a threaded part to be fastened to the penetration threaded part of the connector in a threaded manner, having a length shorter than that of the penetration threaded part, and having on an outer circumference thereof wings arranged at regular intervals, each of the wings having a shape of a triangular plate which is sharp at a tip thereof; and, a spring positioned between the stopper and the penetration rotary unit, and providing a restoring force to bias the penetration rotary unit toward the arrowhead.

2. The arrow as set forth in claim 1, wherein an entire portion of the penetration rotary unit is made of metal, or plastic is prepared for a cylindrical body of the penetration rotary unit and metal is prepared for the wings such that the penetration rotary unit is formed through injection molding, or the penetration rotary unit is formed through powder injection molding (PIM) using metal powder.

3. The arrow as set forth in claim 1, wherein the threads of the penetration threaded part and the threaded part provided on the inner circumference of the penetration rotary unit are formed into one of a double-thread screw to a five-thread screw.

4. The arrow as set forth in claim 1, wherein a longitudinal central line of each of the wings of the penetration rotary unit is inclined relative to a longitudinal central line of the penetration rotary unit, and each of the wings has a section which is curved in an arc shape.

5. The arrow as set forth in claim 4, wherein the threads of the penetration threaded part and the threaded part provided on the inner circumference of the penetration rotary unit are formed into one of a double-thread screw to a five-thread screw.

6. The arrow as set forth in claim 4, wherein an entire portion of the penetration rotary unit is made of metal, or plastic is prepared for a cylindrical body of the penetration rotary unit and metal is prepared for the wings such that the penetration rotary unit is formed through injection molding, or the penetration rotary unit is formed through powder injection molding (PIM) using metal powder.

7. The arrow as set forth in claim 6, wherein the threads of the penetration threaded part and the threaded part provided on the inner circumference of the penetration rotary unit are formed into one of a double-thread screw to a five-thread screw.

8. The arrow as set forth in claim 4, wherein a longitudinal central line of each of the feathers is inclined relative to a longitudinal central line of the arrow shaft, so that air resistance affects the feathers while the arrow shaft is flying, thus allowing the arrow shaft to rotate when flying.

9. The arrow as set forth in claim 8, wherein an entire portion of the penetration rotary unit is made of metal, or plastic is prepared for a cylindrical body of the penetration rotary unit and metal is prepared for the wings such that the penetration rotary unit is formed through injection molding, or the penetration rotary unit is formed through powder injection molding (PIM) using metal powder.

10. The arrow as set forth in claim 8, wherein the threads of the penetration threaded part and the threaded part provided on the inner circumference of the penetration rotary unit are formed into one of a double-thread screw to a five-thread screw.

11. The arrow as set forth in claim 1, wherein a longitudinal central line of each of the feathers is inclined relative to a longitudinal central line of the arrow shaft, so that air resistance affects the feathers while the arrow shaft is flying, thus allowing the arrow shaft to rotate when flying.

12. The arrow as set forth in claim 11, wherein an entire portion of the penetration rotary unit is made of metal, or plastic is prepared for a cylindrical body of the penetration rotary unit and metal is prepared for the wings such that the penetration rotary unit is formed through injection molding, or the penetration rotary unit is formed through powder injection molding (PIM) using metal powder.

13. The arrow as set forth in claim 11, wherein the threads of the penetration threaded part and the threaded part provided on the inner circumference of the penetration rotary unit are formed into one of a double-thread screw to a five-thread screw.

* * * * *